US007694808B1

(12) United States Patent
Lin et al.

(10) Patent No.: US 7,694,808 B1
(45) Date of Patent: Apr. 13, 2010

(54) GOLF CLUB TRANSPORT CASE WITH TETHERED SECURITY PIN

(75) Inventors: Alex Kan Chiao Lin, Arlington, TX (US); Christopher Shannon Sides, Southlake, TX (US)

(73) Assignee: Plano Molding Company, Plano, IL (US)

( * ) Notice: Subject to any disclaimer, the term of this patent is extended or adjusted under 35 U.S.C. 154(b) by 882 days.

(21) Appl. No.: 11/428,889

(22) Filed: Jul. 6, 2006

(51) Int. Cl.
*A63B 55/00* (2006.01)

(52) U.S. Cl. ..... 206/315.3; 70/64

(58) Field of Classification Search ..... 206/315.3; 70/163, 81, 164, 64
See application file for complete search history.

(56) References Cited

U.S. PATENT DOCUMENTS 1,856,837 A * 5/1932 Kip ..... 206/315.5
D336,603 S * 6/1993 Penaflor ..... D8/336
5,815,873 A 10/1998 Jones
6,102,202 A * 8/2000 Jones ..... 206/315.6
6,112,895 A * 9/2000 Ryan ..... 206/315.6
6,196,385 B1 * 3/2001 Thompson et al. ..... 206/315.6
6,595,356 B1 7/2003 Homoly
2006/0096682 A1 * 5/2006 Hsieh ..... 150/159

* cited by examiner

*Primary Examiner*—Tri M Mai
(74) *Attorney, Agent, or Firm*—McGuirewoods LLP

(57) ABSTRACT

A golf club transport case includes a first tubular body having a closed end and open end. A second elongated tubular body includes a closed end and an open end adapted to mate with and overlap the open end of the first tubular body to define an enclosed tubular body. A keyway extends diametrically through the overlapped open ends of the first and second bodies of the enclosed tubular body. A pin extends through the keyway to secure the first body to the second body. The pin has a first end and a second end. The first end thereof is attached to the first body and the second end thereof is adapted to be removably secured to a lock to thereby prevent removal of the pin from the keyway.

1 Claim, 2 Drawing Sheets

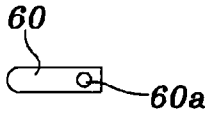
FIG. 4
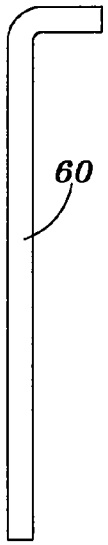
FIG. 5
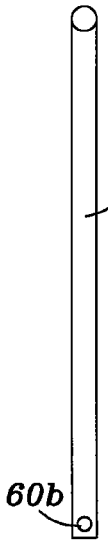
FIG. 6
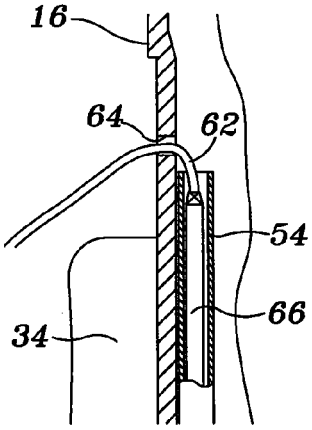
FIG. 7
FIG. 3
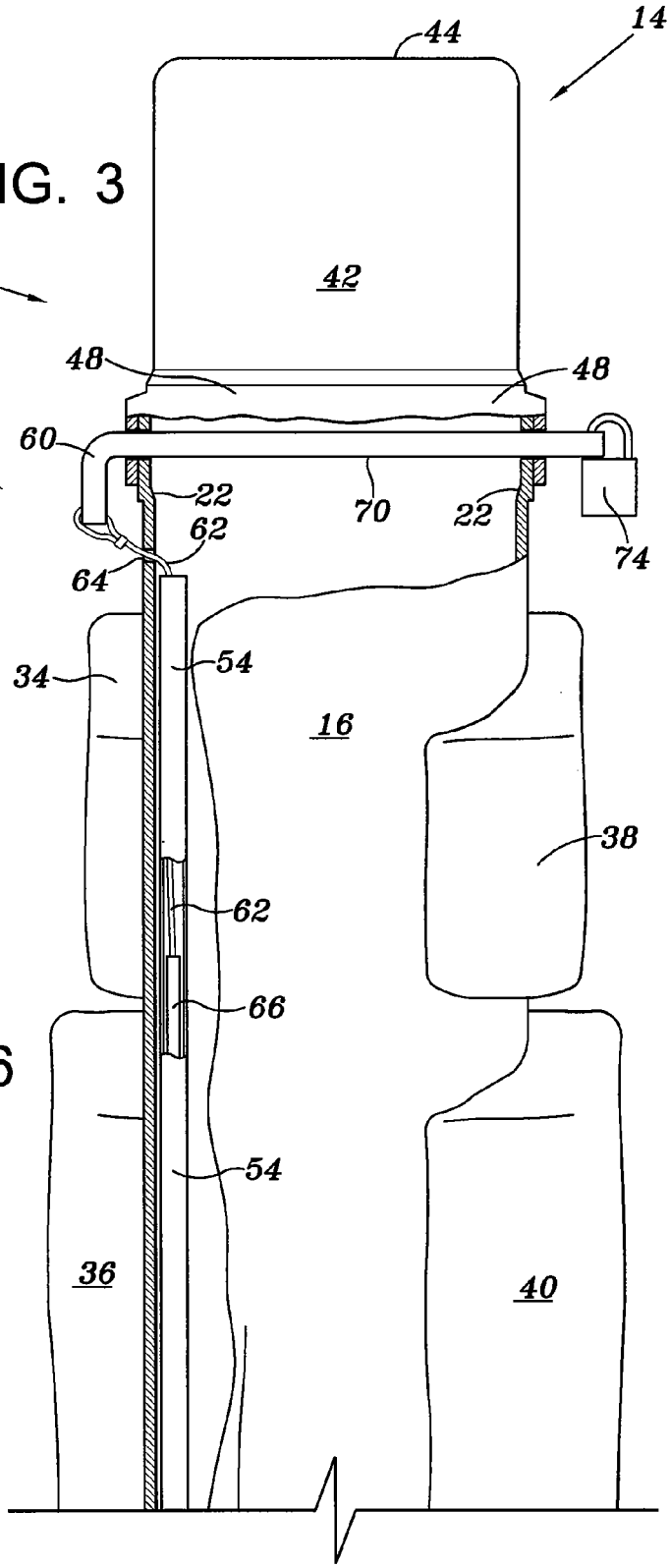

GOLF CLUB TRANSPORT CASE WITH TETHERED SECURITY PIN

TECHNICAL FIELD OF THE INVENTION

The present invention relates to transport bags and cases, for sports equipment such as golf clubs, and more particularly to a transport case having a tethered security pin.

BACKGROUND OF THE INVENTION

Golfers who prefer to use their own personal clubs when playing courses remote from the golfer's residence face the problem of transporting their golf clubs from home to the remote golf course without loss or damage to their golf clubs. Various transport cases for golf clubs are widely used.

When used to ship golf clubs as baggage or freight, the case must be sufficiently secure to prevent theft of the equipment contained therein. U.S. Pat. No. 6,595,356 illustrates the use of a golf club transport case having a security pin to provide a tamper-proof closure which is locked in place to prevent unauthorized entry into or removal of the contents of the case. However, the security pin may become misplaced or lost, after removal, therefore the security feature of this case may not always be available.

A need is thus arisen for a golf club transport case where a security pin is utilized to lock the case and wherein loss of the security pin is prevented.

SUMMARY OF THE INVENTION

In accordance with the present invention, a golf club transport case is provided. The case includes a first tubular body having a closed end and open end. A second elongated tubular body includes a closed end and an open end adapted to mate with and overlap the open end of the first tubular body to define an enclosed tubular body. A keyway extends diametrically through the overlapped open ends of the first and second bodies of the enclosed tubular body. A pin extends through the keyway to secure the first body to the second body. The pin has a first end and a second end. The first end thereof is attached to the first body and the second end thereof is adapted to be removably secured to a lock to thereby prevent removal of the pin from the keyway.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which:

FIG. 3 is a front elevational view of the case of FIG. 1, partially broken away, illustrating the cap in place, and the tethered security pin locked in place;

FIG. 4 is an end view of the present tethered security pin;

FIG. 5 is a side view of the present tethered security pin;

FIG. 6 is a bottom view of the present tethered security pin; and

FIG. 7 is an enlarged side view of a portion of the present case shown in FIG. 2.

DESCRIPTION OF THE PREFERRED EMBODIMENTS

Figure 1:
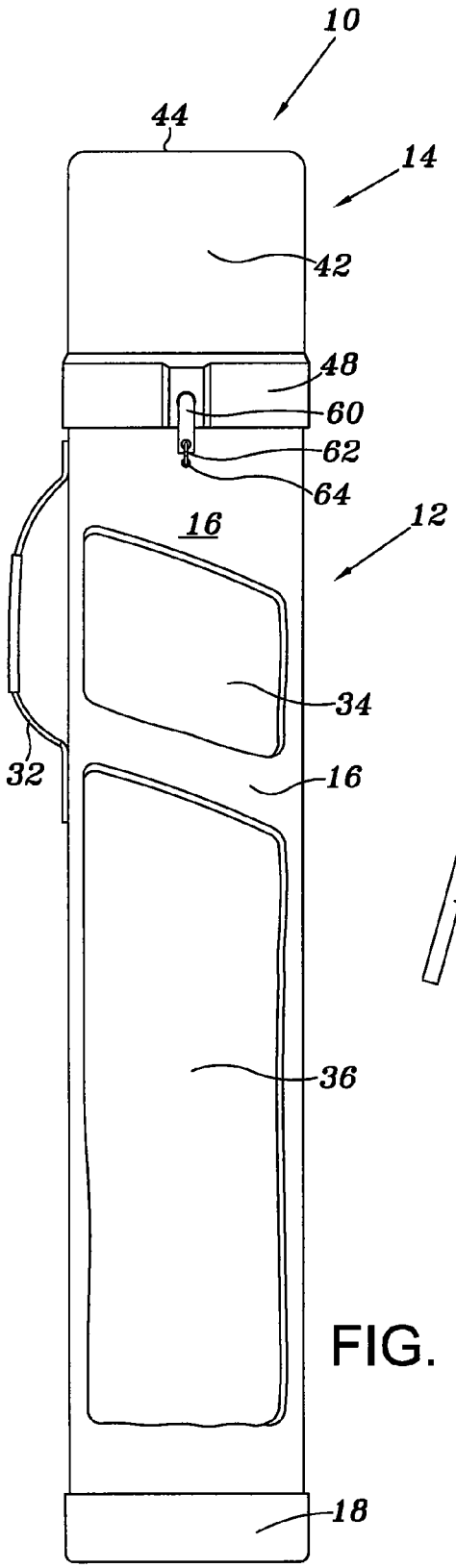
FIG. 1 is a side elevational view of a golf club transport case in accordance with the present invention.
Figure 2:
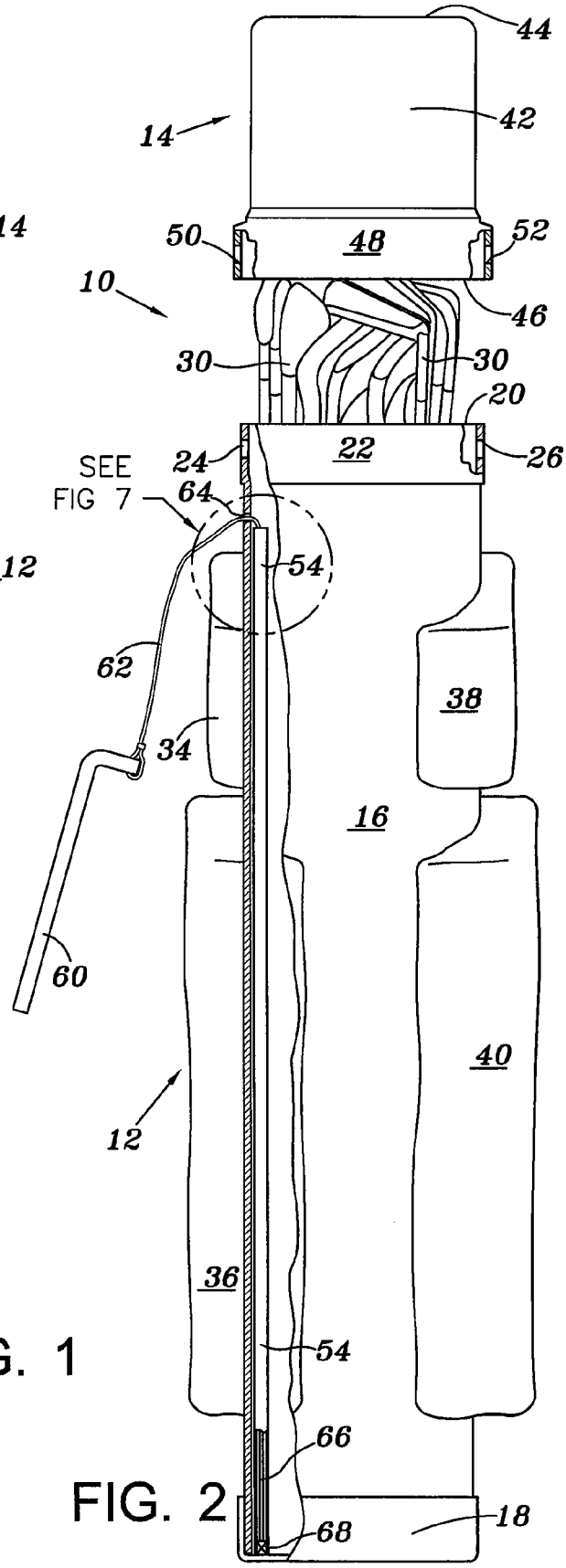
FIG. 2 is a front elevational view of the case of FIG. 1, partially broken away, with the cap exploded, illustrating the present tethered security pin.

Referring simultaneously to FIGS. 1, 2 and 3, the present golf club transport case is illustrated, and is generally identified by the numeral 10. The term "case" and "bag" are used interchangeably herein to mean any structure used as a container to transport sports equipment, such as for example, golf clubs. The term "tubular" used herein is used to refer to any elongated hollow structure wherein the cross-sectional configuration is circular, rectangular, oval, or any other shape.

Case 10 includes a first elongated tubular body, generally identified by the numeral 12. Case 10 further includes a second elongated tubular body, generally identified by the numeral 14. Second elongated tubular body 14 when assembled to first elongated tubular body 12 creates an enclosed tubular body for containing and transporting sports equipment, such as, for example, golf clubs.

First elongated tubular body 12 includes a bag 16 having a closed end 18 and an open end 20 (FIG. 2). Secured adjacent to open end 20 of bag 16 is a collar 22. Collar 22 includes diametrically opposed apertures 24 and 26.

Bag 16 contains and transports golf clubs 30, which are inserted into bag 16 via open end 20 of bag 16. Bag 16 further includes a handle 32 and pockets 34, 36, 38 and 40.

Second elongated tubular body 14 includes a cap 42 having a closed end 44 and an open end 46 (FIG. 2). Adjacent to open end 46 is a collar 48. Collar 48 includes diametrically opposed apertures 50 and 52.

The diameter of collar 48 is complementary with the diameter of collar 22, such that collar 48 is telescoped over collar 22 as illustrated in FIG. 3. When golf club transport case 10 is assembled, as illustrated in FIG. 1, collar 48 mates snuggly with collar 22 to form a rigid connection between case 16 and cap 42 to form a secure transport closure for golf clubs 30 within case 10.

To securely maintain bag 16 and cap 42 locked together, a security pin 60 (FIG. 5) is utilized. Security pin 60 includes a first end having an aperture 60*a* (FIG. 4) and a second end having an aperture 60*b* (FIG. 6). Aperture 60*a* of security pin 60 receives a cable 62 to attach cable 62 to security pin 60. Cable 62 extends through an aperture 64 within bag 16 and is attached to an elastic band 66 (FIG. 7). Elastic band 66 is attached to end 18 at attachment point 68 (FIG. 2). Through the use of cable 62 and elastic band 66, security pin 60 is always securely attached to case 10 to thereby prevent loss of security pin 60 when not in use. Cable 62 and elastic band 66 are housed within a sleeve 54 attached to the interior of case 16.

Referring to FIG. 3, security pin 60 is illustrated in the secured position of cap 42 and case 16. Security pin 60 is inserted within aligned apertures 24 and 50 and aligned apertures 26 and 52 (FIG. 2). Cap 42 and bag 16 are alignable such that a keyway 70 is formed between apertures 24 and 26 of bag 16 and apertures 50 and 52 of cap 42 to allow security pin 60 to be inserted through the mating collars 48 and 22. Security pin 60 extends through keyway 70, such that pin 60 extends from case 10. Aperture 60*b* receives a suitable lock such as, for example, lock 74 to prevent unauthorized extraction of pin 60 from keyway 70 and case 10.

Security pin 60 is tethered to case 16 via cable 62 and elastic band 66, and is extendable by stretching elastic band 66 to allow for easy insertion of security pin 60 into keyway 70. FIGS. 2 and 7 illustrate elastic band 66 in a stretched position extending approximately to the top of sleeve 54. As shown in FIG. 3, when security pin 60 is inserted into keyway 70, elastic band 66 returns to its unstretched position thereby retracting cable 62 into sleeve 54 while cable 62 is attached to security pin 60. Therefore security pin 60 is always attached to bag 16 whether cap 42 is secured to bag 16 or not. Elastic band 66 places sufficient tension on pin 60, such that pin 60 is maintained within keyway 70 even though lock 74 is not secured to pin 60, thereby securing cap 42 to case 16.

Other alteration and modification of the invention will likewise become apparent to those of ordinary skill in the art upon reading the present disclosure, and it is intended that the scope of the invention disclosed herein be limited only by the broadest interpretation of the appended claims to which the inventor is legally entitled.

We claim:

1. A golf club transport case comprising:

a first elongated tubular body having a closed end and an open end;

a second elongated tubular body having a closed end and an open end, said open end adapted to mate with and overlap said open end of said first tubular body to thereby define an enclosed tubular body;

a keyway extending diametrically through said overlapped open ends of said first and said second bodies of said enclosed tubular body;

a pin selectively extending through said keyway to secure said first body to said second body; and said pin having a first end and a second end, said first end thereof being attached to said first body and said second end thereof adapted to be removably secured to a locking device to thereby prevent removal of said pin from said keyway;

a cable having a first end and a second end, said first end thereof being attached to said first end of said pin and said second end of said cable being attached to said first body; and an elastic strip disposed within said first body and having a first end and a second end, said first end thereof being attached to said second end of said cable and said second end of said elastic strip being attached to said first body.

* * * * *